US010494148B2

(12) United States Patent
O'Hagan

(10) Patent No.: US 10,494,148 B2
(45) Date of Patent: Dec. 3, 2019

(54) FLEXIBLE PEELABLE/RESEALABLE PACKAGE

(71) Applicant: Bemis Company, Inc., Neenah, WI (US)

(72) Inventor: Brian R. O'Hagan, Appleton, WI (US)

(73) Assignee: Bemis Company, Inc., Neenah, WI (US)

( * ) Notice: Subject to any disclaimer, the term of this patent is extended or adjusted under 35 U.S.C. 154(b) by 0 days.

(21) Appl. No.: 15/556,706

(22) PCT Filed: Mar. 27, 2015

(86) PCT No.: PCT/US2015/022917
§ 371 (c)(1),
(2) Date: Sep. 8, 2017

(87) PCT Pub. No.: WO2016/159928
PCT Pub. Date: Oct. 6, 2016

(65) Prior Publication Data

US 2018/0057218 A1 Mar. 1, 2018

(51) Int. Cl.
*B65D 33/20* (2006.01)
*B65D 75/58* (2006.01)

(52) U.S. Cl.
CPC ..... *B65D 33/20* (2013.01); *B65D 75/5855* (2013.01)

(58) Field of Classification Search
CPC ..... B65D 33/20; B65D 75/5855
USPC ..... 383/5, 210, 211, 204, 62, 95
See application file for complete search history.

(56) References Cited

U.S. PATENT DOCUMENTS

| | | | | |
|---|---|---|---|---|
| 3,329,331 | A | 7/1967 | Morgan | |
| 4,543,139 | A | 9/1985 | Freedman et al. | |
| 4,582,555 | A | 4/1986 | Bower | |
| 5,089,320 | A | 2/1992 | Straus et al. | |
| 5,382,472 | A | 1/1995 | Yanidis et al. | |
| 5,401,533 | A * | 3/1995 | Borland | B29C 65/76 427/208.2 |
| 5,882,749 | A * | 3/1999 | Jones | B32B 27/322 428/34.8 |
| 5,882,789 | A * | 3/1999 | Jones | B32B 7/06 428/34.8 |
| 6,076,969 | A | 6/2000 | Jaisle et al. | |
| 7,862,869 | B2 | 1/2011 | Papenfuss et al. | |
| 8,091,323 | B2 | 1/2012 | Paterson | |
| 8,256,636 | B2 | 9/2012 | Huffer | |
| 8,354,132 | B2 | 1/2013 | Stephens et al. | |

(Continued)

FOREIGN PATENT DOCUMENTS

| | | |
|---|---|---|
| EP | 1077186 B1 | 4/2005 |
| EP | 2067717 A1 | 12/2008 |

(Continued)

*Primary Examiner* — Jes F Pascua
(74) *Attorney, Agent, or Firm* — Tom J. Hall; Christine E. Parsons

(57) ABSTRACT

The present invention is directed to flexible peelable/resealable packages having a first wall panel which includes an abuse layer forming an exterior surface of the package with a printed release lacquer coating positioned on the abuse layer and a pressure sensitive adhesive coating positioned on the release lacquer coating which may be in direct contact with the sealant substrate forming a portion of the interior surface of the package.

20 Claims, 9 Drawing Sheets

(56) References Cited

U.S. PATENT DOCUMENTS

| | | | | |
|---|---|---|---|---|
| 8,360,643 | B2 * | 1/2013 | Komro | B65D 75/5855 383/111 |
| 8,440,293 | B2 * | 5/2013 | Yasuike | B32B 7/12 264/171.1 |
| 8,551,588 | B2 * | 10/2013 | Daffner | B65D 77/2056 428/35.2 |
| 10,071,841 | B2 * | 9/2018 | Tracy | B65D 75/5827 |
| 2006/0198986 | A1 | 9/2006 | Keckeisen et al. | |
| 2007/0104395 | A1 | 5/2007 | Kinigakis et al. | |
| 2010/0172604 | A1 * | 7/2010 | Andersson | B65D 75/366 383/211 |
| 2010/0247003 | A1 * | 9/2010 | Huffer | B65D 33/20 383/207 |
| 2017/0088313 | A1 * | 3/2017 | Tracy | B65D 75/5827 |
| 2018/0071974 | A1 * | 3/2018 | Huffer | B65D 75/5855 |

FOREIGN PATENT DOCUMENTS

| | | | |
|---|---|---|---|
| FR | 2783512 | A1 | 6/2015 |
| WO | 2015002651 | A1 | 1/2015 |

* cited by examiner

"OPEN" FIG. 5A

"CLOSED" FIG. 6A

"OPEN" FIG. 7A

"OPEN" FIG. 5B

"CLOSED" FIG. 6B

"OPEN" FIG. 7B

FLEXIBLE PEELABLE/RESEALABLE PACKAGE

BACKGROUND OF THE INVENTION

The present invention relates generally to primary packaging and more particularly, to flexible peelable/resealable packages.

Certain packages for food products comprised of particulates, such as shredded cheese, cereal, trail mix, nuts, dried fruit, small cookies, crackers, chocolate, confections, for example, comprise a pouch which is open at one end, or along one side, so as to allow product to be poured or shaken through a reclosable opening.

One widely used means of providing package reclosability is to employ zippers compatible with flexible packages of plastic film construction. Product packaging having zipper reclose mechanisms are often employed for packaging products in situations where the consumer may wish to remove only a portion of the product and to reclose the package. One problem with such zippers is that application of zippers to a film roll makes the film roll bulky and more difficult to handle. Although packaging zippers can be applied in high speed in-line form-fill-seal operations, the equipment requirements for application of zippers and the expense of the zipper materials can be significant. While mechanical closures can be applied in form-fill-seal operations, it often requires complex manufacturing steps to apply, interconnect, and align the mechanical fastening features of each structure. Therefore, mechanical reclosable fasteners often add undue complexity, cost, and expense into the flexible packaging manufacture. In addition, zippers may not provide hermetic seals when desired. Also, some consumers have difficulty operating and manipulating zipper closures.

Improvements are desired in packaging closures which are simple and economical yet reliable, and durable.

SUMMARY OF THE INVENTION

The present invention is directed to flexible peelable/resealable packages having a top end and a bottom end generally opposite the top end, a first side edge and a second side edge generally opposite the first side edge, and a first wall panel having an interior surface and an exterior surface. The first wall panel includes a thermoplastic sealant substrate forming the interior surface of the first wall panel and having an area defined by a length extending between the top end and the bottom end and a width extending between the first side edge and the second side edge. The first wall panel further includes an abuse layer forming the exterior surface of the first wall panel and having an area contiguous with the area of the sealant substrate of the first wall panel, and a printed release lacquer coating positioned on the abuse layer and having an area defined by a truncated length relative to the length of the sealant substrate of the first wall panel and a width extending between the first side edge and the second side edge. Printed on the release lacquer is a pressure sensitive adhesive coating positioned on the release lacquer coating and in direct contact with the sealant substrate of the first wall panel.

The package also includes a second wall panel generally opposite the first wall panel having an interior surface and an exterior surface. The second wall panel includes a thermoplastic sealant substrate forming the interior surface of the second wall panel and having an area defined by a length extending between the top end and the bottom end and a width extending between the first side edge and the second side edge. The second wall panel also comprises an abuse layer which may be in direct contact with the sealant substrate of the second wall panel and forming the exterior surface of the second wall panel, wherein the abuse layer has an area contiguous with the sealant substrate of the second wall panel.

One important aspect of the present invention is that the package has a first closed position comprising a transverse fusion heat seal and a first continuous score-line in the first wall panel positioned between the top end and the transverse fusion heat seal such that the transverse fusion heat seal is superimposed over the area of the release lacquer coating of the first wall panel and extends between the first side edge and the second side edge. The transverse fusion heat seal also joins a section of the sealant substrate of the first wall panel to a section of the sealant substrate of the second wall panel thereby enclosing a product within the package. In one preferred embodiment, the package may optionally include a second continuous score-line in the first wall panel positioned between the transverse fusion heat seal and the bottom end. The second continuous score-line in the first wall panel is generally parallel with the first score-line in the first wall panel. In another preferred embodiment, the first and second continuous score-lines both extend from the interior surface of the first wall panel through the sealant substrate.

Another important aspect of the present invention is that the package has an open position where the first wall panel and the second wall panel are separated proximal to the top end. This open position includes an exposed section of the release lacquer coating which becomes a portion of the interior surface of the first wall panel and an exposed section of the pressure sensitive adhesive coating which becomes a portion of the interior surface of the second wall panel. The first continuous score-line is removed upon transitioning from the first closed position to the open position. Furthermore, the section of the sealant substrate of the first wall panel fusion heat sealed to the section of the sealant substrate of the second wall panel in the transverse fusion heat seal is transferred from the first wall panel to the second wall panel upon transitioning from the first closed position to the open position.

Another important aspect of the present invention is that the package has a second closed position comprising an adhesive seal between the exposed section of the release lacquer coating on the interior surface of the first wall panel and the exposed section of the pressure sensitive adhesive coating the portion of the interior surface of the second wall panel.

As used herein, the terms "heat seal" and "fusion heat seal", and the like refer to a first portion of a film surface (i.e., formed from a single layer or multiple layers) which is capable of forming a hermetic fusion bond to a second portion of a film surface typically under heat and pressure. A heat-seal layer is capable of fusion bonding by conventional indirect heating means which generate sufficient heat on at least one film contact surface for conduction to the contiguous film contact surface and formation of a bond interface therebetween without loss of the film integrity. It should be recognized that heat sealing can be performed by any one or more of a wide variety of manners, such as using a heat seal technique (e.g., melt-bead sealing, thermal sealing, impulse sealing, ultrasonic sealing, hot air, hot wire, infrared radiation, etc.).

BRIEF DESCRIPTION OF THE DRAWINGS

Further features and advantages of the present invention will become apparent from the following detailed description, taken in combination with the appended drawings, in which:

FIG. 7A is a cross-sectional side view of the package of FIG. 6A in an open position after a transverse fusion heat seal was formed and after the package has been opened to expose a section of a release lacquer coating and a section of a pressure sensitive adhesive coating.

FIG. 7B is a cross-sectional side view of the package of FIG. 6B in an open position after a transverse fusion heat seal was formed and after the package has been opened to expose a section of a release lacquer coating and a section of a pressure sensitive adhesive coating.

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
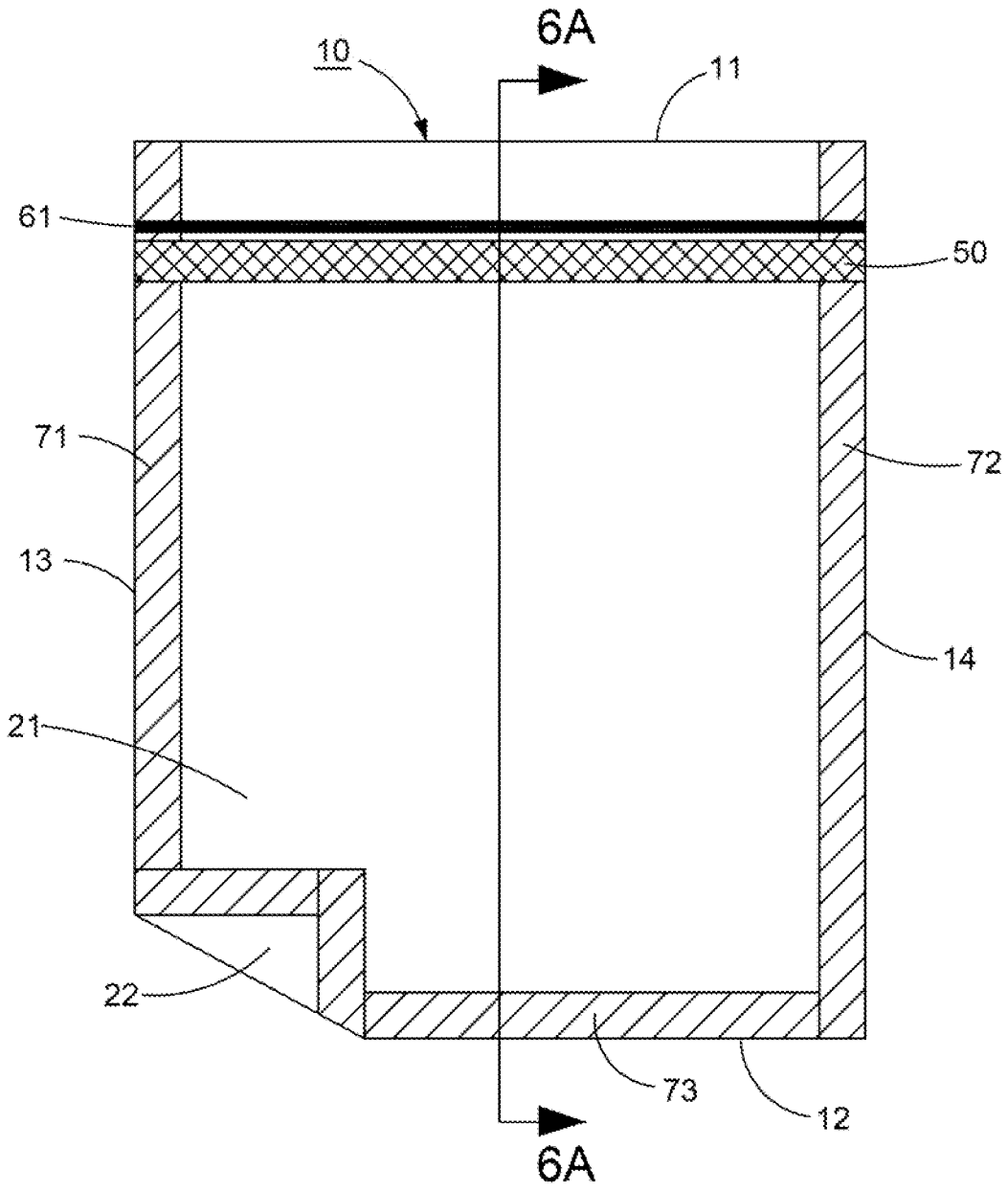
FIG. 1 is a schematic view of one embodiment of a package according to the present invention.
Figure 2:
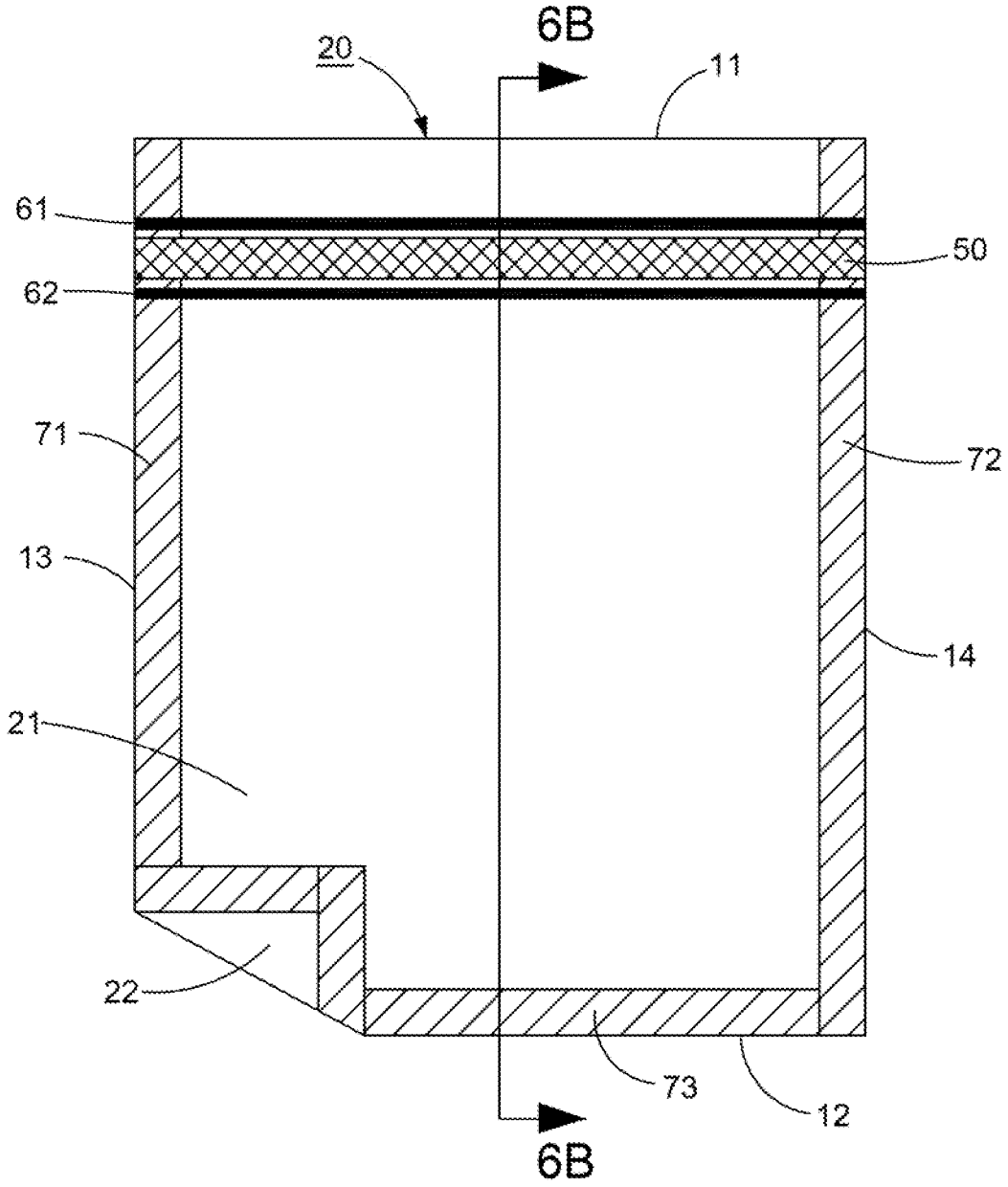
FIG. 2 is a schematic view of another embodiment of a package according to the present invention.

Shown in FIGS. 1-4 are preferred embodiments of the flexible peelable/resealable packages 10, 20, 30 and 40, respectively, of the present invention. Each of these embodiments includes a top end 11, an opposing bottom end 12, a first side edge 13 and a second side edge 14 generally opposite the first side edge. It is within the scope of the present invention for the flexible peelable/resealable package can include any number of seals or heat seals as needed for a particular packaging application. In the preferred embodiments depicted in FIGS. 1 and 2, the packages of the present invention include a transverse fusion heat seal 50 (indicated by cross-hatching) located near top end 11 of the package which extends from the first side edge 13 to the second side edge 14, a first longitudinal side seal 71 positioned proximal to the first side edge 13 extending from the top end 11 to the bottom end 12, and a second longitudinal side seal 72 positioned proximal to the second side edge 14 extending from the top end to the bottom end. The first and second longitudinal side seals may be formed by a cold seal material or an adhesive, fusion heat sealing, or a combination of a cold seal material or an adhesive and fusion heat sealing. In these embodiments, the packages further include a transverse end seal 73 positioned proximal to bottom end 12 which extends across the package from first side edge 13 to second side edge 14. In one preferred embodiment depicted in FIG. 1, package 10 also includes a first continuous score-line 61 in a first wall panel 21 positioned between the top end 11 and transverse fusion heat seal 50. As can be seen in FIG. 1, this first continuous score-line 61 is preferably positioned above, but not within transverse fusion seal 50. In another preferred embodiment depicted in FIG. 2, package 20 includes a first continuous score-line 61 in a first wall panel 21 positioned between the top end 11 and transverse fusion heat seal 50, and a second continuous score-line 62 in the first wall pane 21 positioned between transverse fusion seal 50 and the bottom end 12. As illustrated in FIG. 2, this second continuous score-line 62 is positioned below, but not within transverse fusion seal 60 and is generally parallel with first continuous score-line 61. Score-lines may be formed by any mechanical and/or optical scoring, cutting or perforating methods known in the art. One example of a scoring technique which may be used to assist in the formation of score-lines is optical ablation using a laser source. Laser scoring is well-known in the art. Alternatively, packages 10 and 20 may each include a transverse fusion heat seal 50 located near top end 11 which extends from first side edge 13 to second side edge 14, a first longitudinal side seal 71 positioned proximal to the first side edge 13 extending from top end 11 to bottom end 12, a second longitudinal side seal 72 positioned proximal to the second side edge extending from the top end to the bottom end, and a fold (not shown) positioned proximal to the bottom end.

Figure 3:
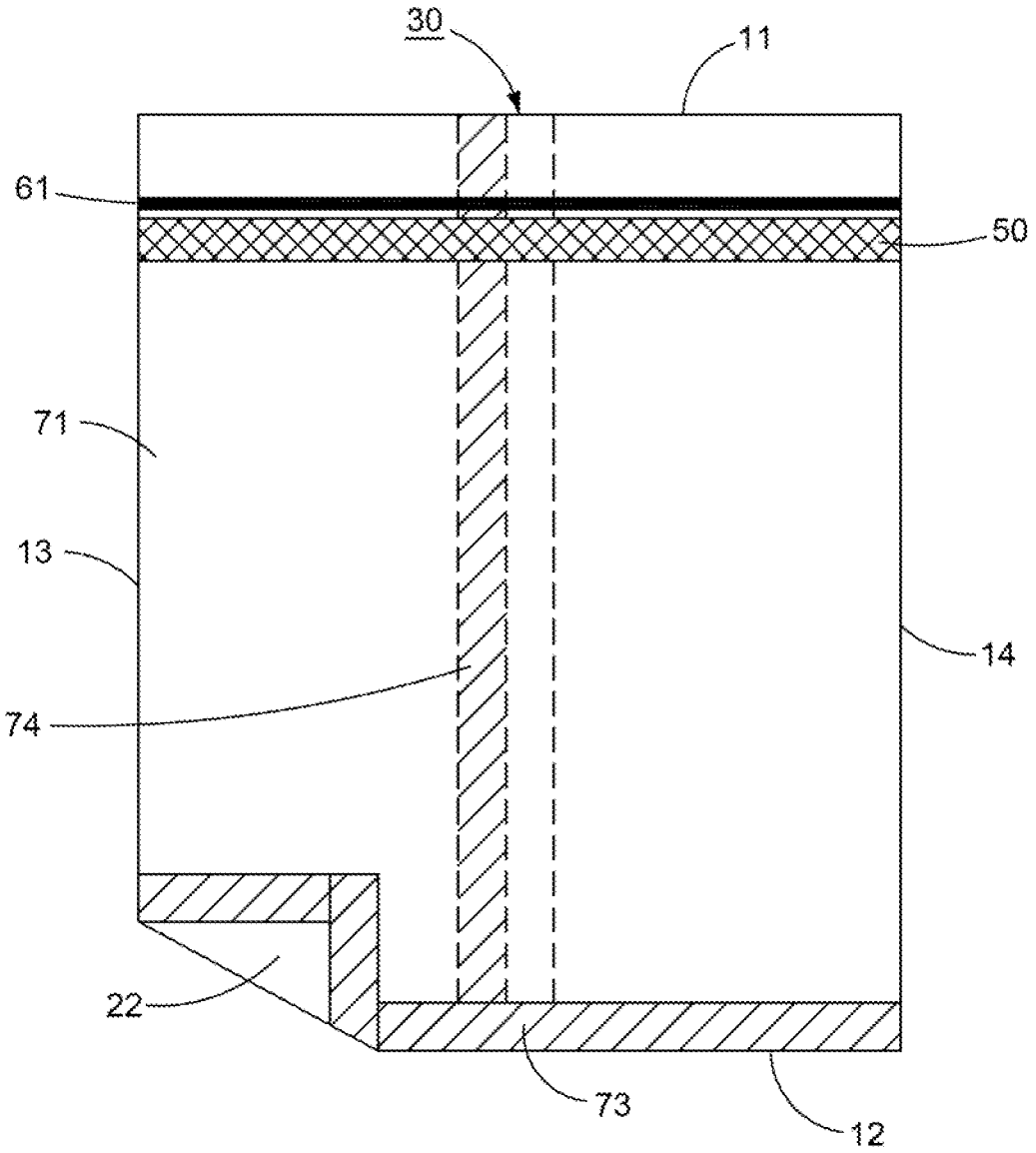
FIG. 3 is a schematic view of still another embodiment of a package according to the present invention.
Figure 4:
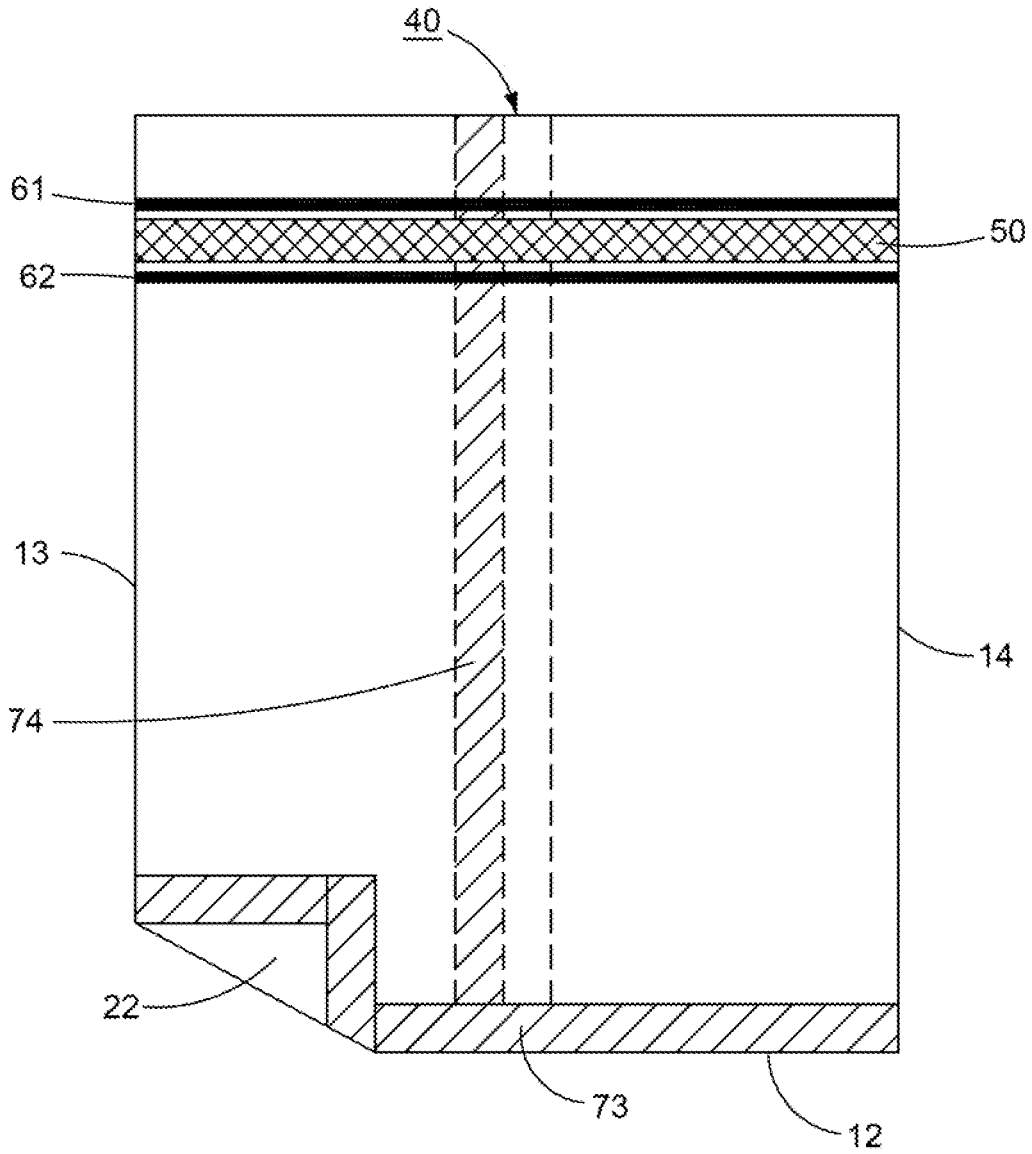
FIG. 4 is a schematic view of yet another embodiment of a package according to the present invention.

Turning now to other preferred embodiments of the present invention illustrated in FIGS. 3 and 4, packages 30 and 40 may each include a transverse fusion heat seal 50 located near top end 11 which extends from first side edge 13 to second side edge 14, a first longitudinal side seal 71 positioned proximal to the first side edge 13 extending from top end 11 to bottom end 12, a second longitudinal side seal 72 positioned proximal to the second side edge extending from the top end to the bottom end, and a longitudinal seal 74 positioned between the first and second side edges, 13 and 14, which extends between the top edge 11 and the bottom edge 12. Longitudinal seal 74 may be configured as either a fin seal or a lap seal. Methods of forming both fin and lap seals are well-known to those skilled in the art. In these preferred embodiments, the packages 30 and 40 also include a transverse end seal 73 positioned proximal to bottom end 12 which extends across the package from first side edge 13 to second side edge 14.

The flexible peelable/resealable packages of the present invention are constructed from a first wall panel 21 having an interior surface 21*a* and an exterior surface 21*b*, and a second wall panel 22 having an interior surface 22*a* and an exterior surface 22*b* as can be seen in FIGS. 5A-8. First wall panel 21 includes a thermoplastic sealant substrate 211 which forms the interior surface 21*a* of first wall panel 21. Included in this first wall panel is also an abuse layer 212 forming the exterior surface 21*b* of first wall panel 21, a printed release lacquer coating 213 positioned on abuse layer 212 which has an area defined by a truncated length relative to the length of the sealant substrate 211 of the first wall panel 21 and a width extending between first side edge 13 and the second side edge 14. In preferred embodiments, the length of release lacquer coating 213 may be between 2 mm and 20 mm or between 5 mm and 10 mm. First wall panel 21 further comprises a printed pressure sensitive adhesive coating 214 applied to release lacquer coating 213. In one preferred embodiment, pressure sensitive adhesive coating 214 covers an area no larger than the area of release lacquer coating 213. Placement of pressure sensitive adhesive coating 214 in register with release lacquer coating 213 may be achieved by conventional flexographic and/or rotogravure printing methods well-known in the art. As is depicted, placement of each of first and second continuous score-lines 61 and 62 is within the area defined by at least one of the printed release lacquer coating 213 and printed pressure sensitive adhesive coating 214. In one preferred embodiment, the release lacquer coating 213 and pressure sensitive adhesive coating 214 each cover identical areas relative to abuse layer 212 and placement of each of first and second continuous score-lines 61 and 62 is within the area defined by pressure sensitive adhesive coating 214. Second wall panel 22 includes a thermoplastic sealant substrate 221 which forms the interior surface 22*a* of second wall panel 22. The thermoplastic sealant substrate for first wall panel 21 and second wall panel 22 may be formed from either a monolayer film, a multilayer film or a multilayer laminate which may be the same or different film and/or laminate for each wall panel. Similarly, the abuse layer for first wall panel 21 and second wall panel 22 may be formed from either a monolayer film, a multilayer film or a multilayer laminate which may be the same or different film and/or laminate for each wall panel. In one preferred embodiment, thermoplastic sealant substrates 211 and 221 are each a multilayer film having the same number of layers, the same layer sequence and same layer compositions. In another preferred embodiment, abuse layers 212 and 222 are each a monolayer film. First panel 21 may comprise any number of layers which includes, but is not limited to, an additional permanent adhesive layer (not shown) positioned between the sealant substrate 211 and the pressure sensitive adhesive coating 214 and those portions of abuse layer 212 not covered by pressure sensitive adhesive coating 214. In like manner, second panel 22 may comprise any number of layers which includes, but is not limited to, an additional permanent adhesive layer (not shown) positioned between the sealant substrate 221 and the abuse layer 222. In one preferred embodiment, the permanent adhesive layer in both first and second wall panels is the same adhesive material.

Figure 5:
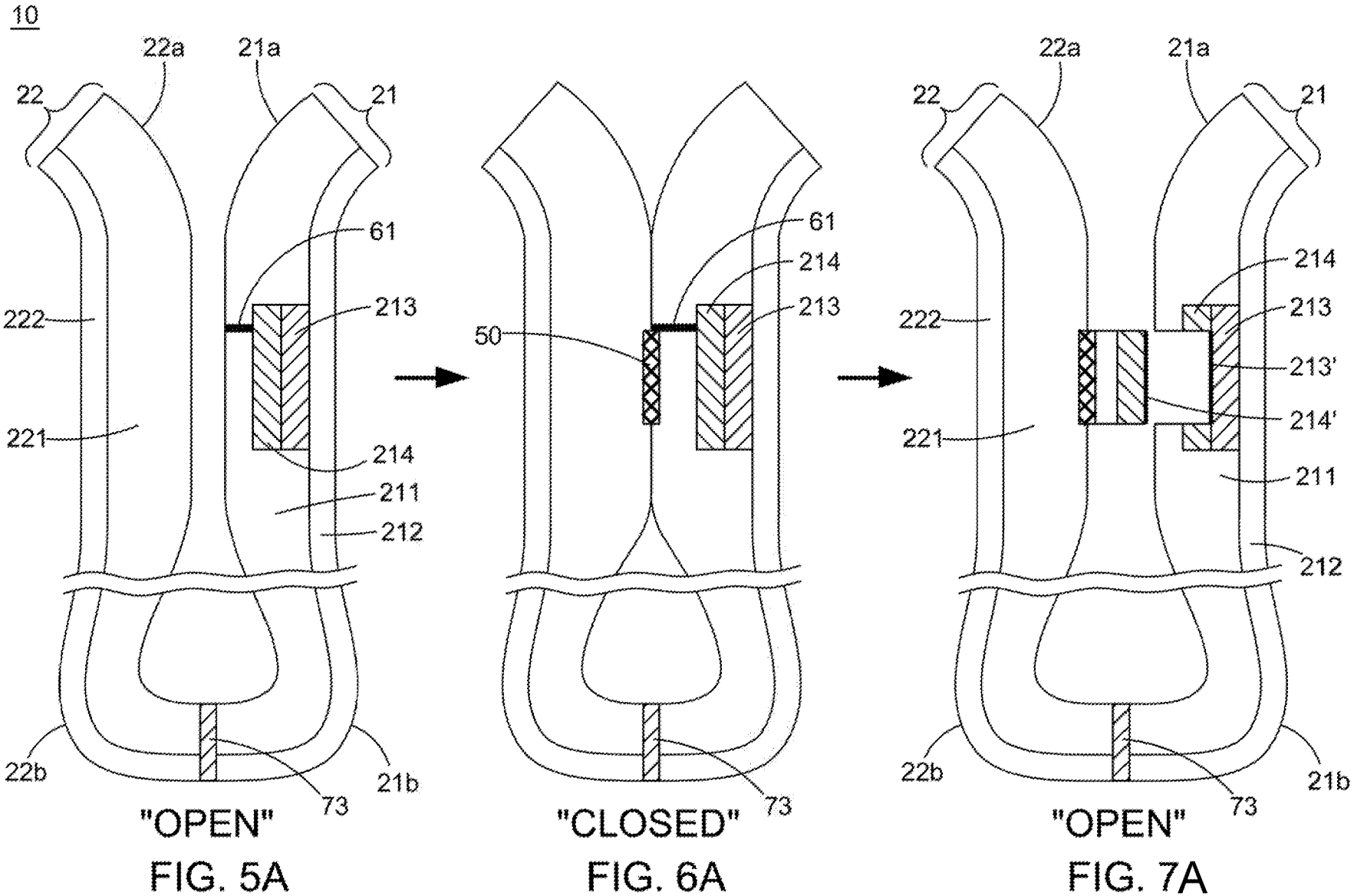
FIG. 5A is a cross-sectional side view of the package of FIG. 1 in an initial open state before a product is placed within the package and before a transverse fusion heat seal is formed according to the present invention.
FIG. 5B is a cross-sectional side view of the package of FIG. 2 in an initial open state before a product is placed within the package and before a transverse fusion heat seal is formed according to the present invention
Figure 6:
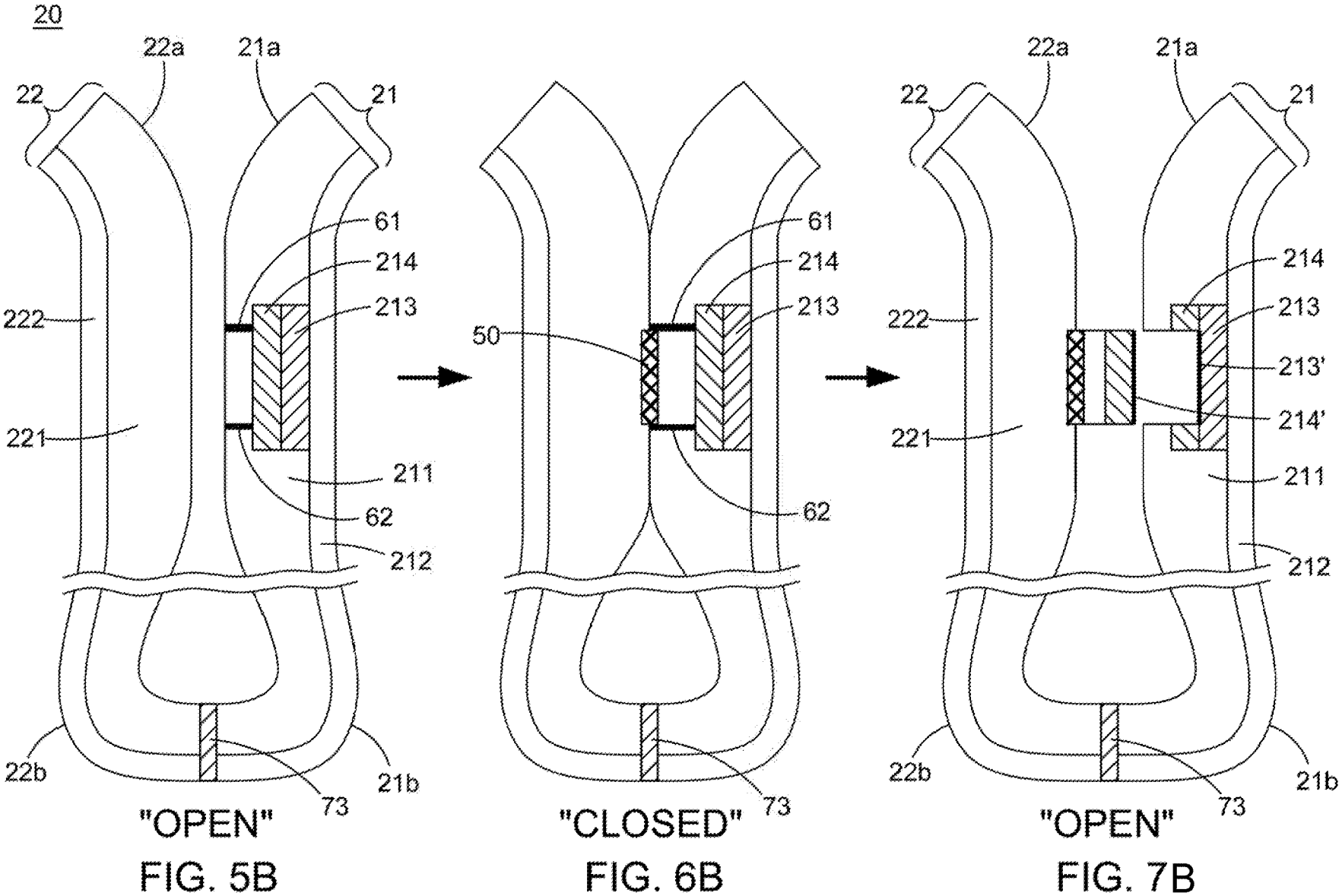
FIG. 6A is a cross-sectional side view of the package of FIG. 1 in a first closed position taken along line 6A-6A after a product is placed within the package and after a transverse fusion heat seal is formed according to the present invention.
FIG. 6B is a cross-sectional side view of the package of FIG. 2 in a closed position taken along line 6B-6B after a product is placed within the package and after a transverse fusion heat seal is formed according to the present invention.

In use, after the required side seals have been created and a first score-line 61 or first and second score-lines 61 and 62 have been configured in-register in the first wall panel 21 as depicted as "OPEN" in FIGS. 5A and 5B, respectively, a product (not shown) may then be placed inside the package and the package sealed by impressing the first and second wall panels 21 and 22 together with heat and pressure using a heat sealing bar (not shown) at a predetermined location on the package. This process creates a first closed position of the package indicated as "CLOSED" which is illustrated by the transition between FIGS. 5A to 6A and FIGS. 5B to 6B. The predetermined location corresponds to an area which is equal to or smaller than the area defined by either release lacquer coating 213, pressure sensitive adhesive coating 214 or both release lacquer coating 213 and pressure sensitive adhesive coating 214. The process of fusion sealing produces a transverse fusion heat seal 50 which is superimposed over an area of at least that which is defined by release lacquer coating 213 as illustrated in FIGS. 6A and 6B. The transverse fusion heat seal 50 joins a section of the sealant substrate 211 of the first wall panel 21 to a section of the sealant substrate 221 of the second wall panel 22 thereby enclosing a product within the package. It should be further noted that the placement of transverse fusion heat seal 50 in first wall panel 21 is accomplished in such a manner so that the first continuous score-line 61 or first and second continuous score-lines 61 and 62 is/are not destroyed or otherwise damaged as the result of creating transverse fusion heat seal 50.

Figures 7, 8:
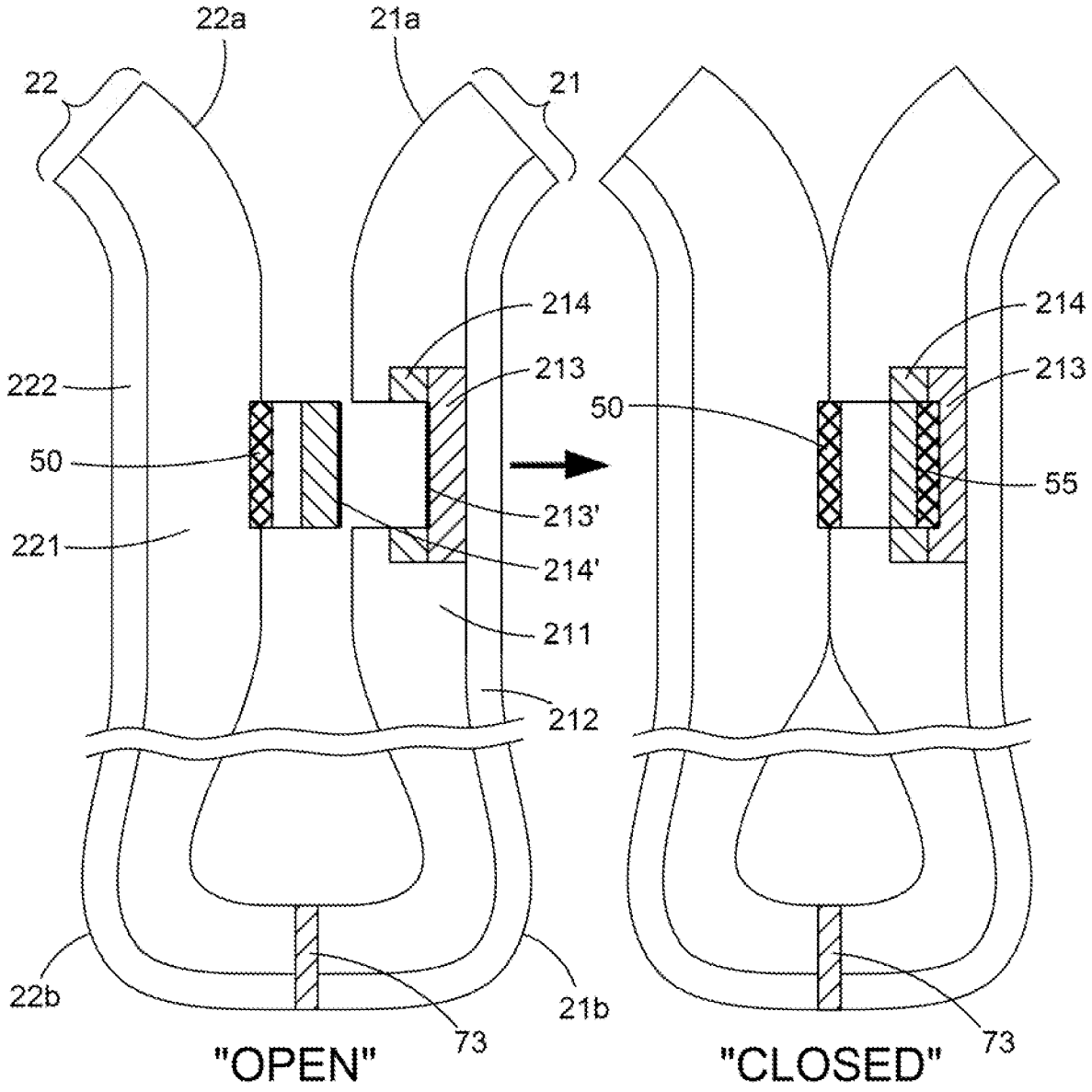
FIG. 7 is a cross-sectional side view of the package in an open position after a transverse fusion heat seal was formed and after the package has been opened to expose a section of a release lacquer coating and a section of a pressure sensitive adhesive coating.
FIG. 8 is a cross-sectional side view of the package of FIG. 7, after the package has been opened and subsequently re-closed.

When the consumer wishes to access the contents of the packages of the present invention, he may grasp the unsealed portions of the first and second wall panels above the transverse fusion heat seal 50 and pull the wall panels away from transverse fusion heat seal 50 thereby creating an open position where the wall panels are separated proximal to the top end of the package as indicated as "OPEN" in FIG. 7. This open position includes an exposed section of the release lacquer coating 213' on the interior surface 21*a* of the first wall panel 21 and an exposed section of the pressure sensitive adhesive coating 214'. The process of creating the open position is illustrated by the transition between FIG. 6A to FIG. 7A and FIG. 6B to FIG. 7B. As can be seen, the exposed section of the pressure sensitive adhesive coating 214' becomes a portion of the interior surface 22*a* of the second wall panel 22 produced when transitioning from the first closed position to the open position. It should be noted that in this open position the first continuous score-line 61 shown in FIG. 6A and the first and second continuous score-lines 61 and 62 shown in FIG. 6B is/are removed upon transitioning from the first closed position to the open position.

When the consumer wishes to re-close the package after its initial opening depicted in FIG. 7, he may readily press the exposed section of the pressure sensitive adhesive coating 214' of the interior surface 22*a* of second wall panel 22 onto the exposed section of the release lacquer coating 213' on the interior surface 21*a* of the first wall panel 21. This creates second closed position comprising an adhesive seal 55 between the exposed section of the release lacquer coating 213' on the interior surface 21*a* of the first wall panel 21 and the exposed section of the pressure sensitive adhesive coating 214' on the portion of the interior surface 22*a* of the second wall panel 22 as indicated as "CLOSED" in FIG. 8. Thus, it should be evident to those skilled in the art that the packages of the present invention are peelable and resealable.

FILM EXAMPLES

Packaging films which incorporate a seal area having a peelable/resealable film interface provide for the consumer an easy means to both open a container without having to tear the package and re-close the container as often as needed. In general, peelable/resealable film interfaces are formed when two film surfaces are bonded or sealed together during the package fabrication process. This seal area or bond is considered "peelable" if the consumer simply grasps a portion of the film and pulls or "peels" it away from a second portion-thereby causing at least two adjacent film layers to delaminate and expose the surface of each layer. The initial force needed to separate the layers is relatively strong before the package is opened in order for the seal area to withstand the expected abuse during the packaging operation, distribution, and storage. By contrast, after the package has been initially opened, the peeling force required to break the seal and re-open the package is relatively weak thereafter. Moreover, the package is considered "resealable" if the consumer simply engages the two exposed film surfaces together-thereby creating an adhesive seal between film surfaces. Generally, the force require to "reseal" the two exposed surfaces is proportional to the pressure exerted on this adhesive bond by the consumer. The force required to affect either an adhesive or a cohesive failure between film surfaces may be measured by its "peel strength" in accordance with ASTM F-904 test methods. A peelable film structure is adapted to remain secure and unbroken during package fabrication, distribution and storage, and yet may be relatively easily ruptured. Accordingly, the peel strength of a frangible layer is between 500 gram-force/inch (87.6 Newton/meter) and 5000 gram-force/inch (875.5 Newton/meter) as measured in accordance with ASTM F-904 test method. As used herein, the term "resealable" refers to a film interface adapted to re-adhere to itself after separation. The force required to "reseal" these interfaces is proportional to the manual pressure exerted on the film. Consequently, a peelable and resealable interface will exhibit a first interfacial peel strength and a second interfacial (or re-tack) peel strength. The peelable, resealable seals of the present invention will have a first peel strength of between 500 gram-force/inch (87.6 Newton/meter) and 2500 gram-force/inch (437.8 Newton/meter) and a second peel strength of between 350 gram-force/inch (61.3 Newton/meter) and 1000 gram-force/inch (175.1 Newton/meter) as measured in accordance with ASTM F-904 test method. In contrast, a permanent adhesive layer cannot be readily manually peeled apart and has a peel strength greater than 2500 gram-force/inch (437.8 Newton/meter).

Figure 9:
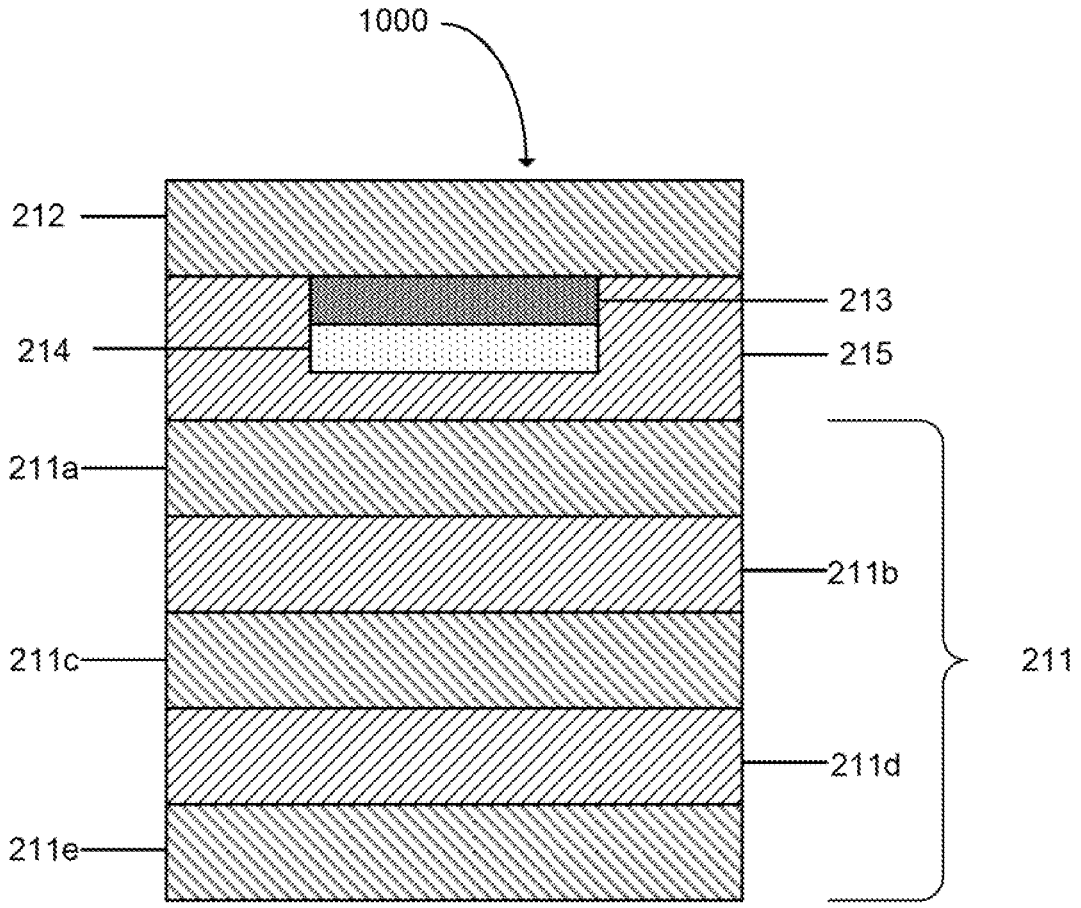
FIG. 9 is a cross-sectional view of a preferred embodiment of a flexible laminate suitable for use as a first wall panel in the present invention.

Referring now to FIG. 9, there is illustrated one preferred embodiment of a laminate 1000 suitable for use as first wall panel 21 in the present invention. In this embodiment, laminate 1000 comprises an abuse layer 212, a release lacquer coating 213 and a pressure sensitive adhesive coating 214, a permanent adhesive layer 215, and a sealant substrate 211 having a first sealant film layer 211*a*, a second sealant film layer 211*b*, a third sealant film layer 211*c*, a fourth sealant film layer 211*d*, and a fifth sealant film layer 211*e*. Abuse layer 212 may comprise any thermoplastic, paper or non-woven material generally recognized by those skilled in the art as abuse resistant which may include, but is not limited to, thermoplastic polymers such as polyethylene, polypropylene, polyethylene terephthalate, polyamide, especially biaxially oriented polypropylene, biaxially oriented polyethylene terephthalate and biaxially oriented polyamide. Abuse layer 212 typically has a total thickness of between 48 gauge and 142 gauge (12.2 μm and 36.1 μm). In one preferred embodiment, the permanent adhesive layer 215 includes a permanent pressure sensitive adhesive which is applied as a flood coat, first sealant film layer 211*a* may include a polyolefin or blend of polyolefins, second sealant film layer 211*b* may include a tie material, third sealant film layer 211*c* may include an oxygen barrier material which may comprise polyimide, ethylene vinyl alcohol copolymer, polyvinylidene chloride, and mixtures thereof, fourth sealant film layer 211*d* may include a polyolefin or blend of polyolefins, and fifth sealant film layer 211*e* may include a heat sealable material. Heat sealable materials may include but are not limited to polyethylenes such as low density polyethylenes, very low density polyethylenes, ultra-low density polyethylenes, linear low density polyethylenes, ethylene α-olefin copolymers; ethylene vinyl acetate copolymers; ethylene methacrylate copolymers, ethylene acrylic acid copolymers, ionomers and blends thereof. The sealant substrate 211 was produced using a blown film co-extrusion apparatus, and methods which are well known to those skilled in the art. The blown film co-extrusion film apparatus includes a multi-manifold flat die head through which the film composition is forced and formed into a flat sheet. The substrate is immediately quenched e.g., via cooled water bath, solid surface and/or air, and then formed into a film. Sealant substrate 211 may comprise any number of layers including, but not limited to, additional abuse layers, tie material layers, oxygen barrier layers and/or moisture barrier layers. Typical tie materials include, but are not limited to anhydride or carboxylic acid modified polyolefins, particularly, maleic anhydride modified polyolefins such as maleic anhydride modified low density polyethylene, maleic anhydride modified linear low density polyethylene, maleic anhydride modified high density polyethylene, maleic anhydride modified ethylene vinyl acetate copolymers and blends thereof. Tie layer materials may further include a blend of an unmodified polyolefin or unmodified ester copolymer or unmodified ethylene acid copolymer and a modified polyolefin or modified ester copolymer or modified ethylene acid copolymer.

The total thickness of laminate 1000 of the present invention is generally from about 19.1 μm (0.75 mil) to about 254 μm (10 mil), most typically from about 63.5 μm (2.5 mil) to about 127 μm (5.0 mil).

One preferred method of fabricating laminate 1000 includes first printing release lacquer coating 213 onto a free-standing film of abuse layer 212 in a predetermined area followed by printing pressure sensitive adhesive coating 214 onto release lacquer coating 213. A flood coat of permanent adhesive 215 is then applied over pressure sensitive adhesive coating 214 and any un-coated area of abuse layer 212 and then laminated to the five-layer free-standing sealant substrate 211. Lastly, this laminated structure is then scored via die cut methods generally well-known in the art. Alternatively, prior to laminating the five-layer free-standing sealant substrate 211, it is first scored then laminated to the free-standing abuse layer film coated with permanent adhesive 215.

Figure 10:
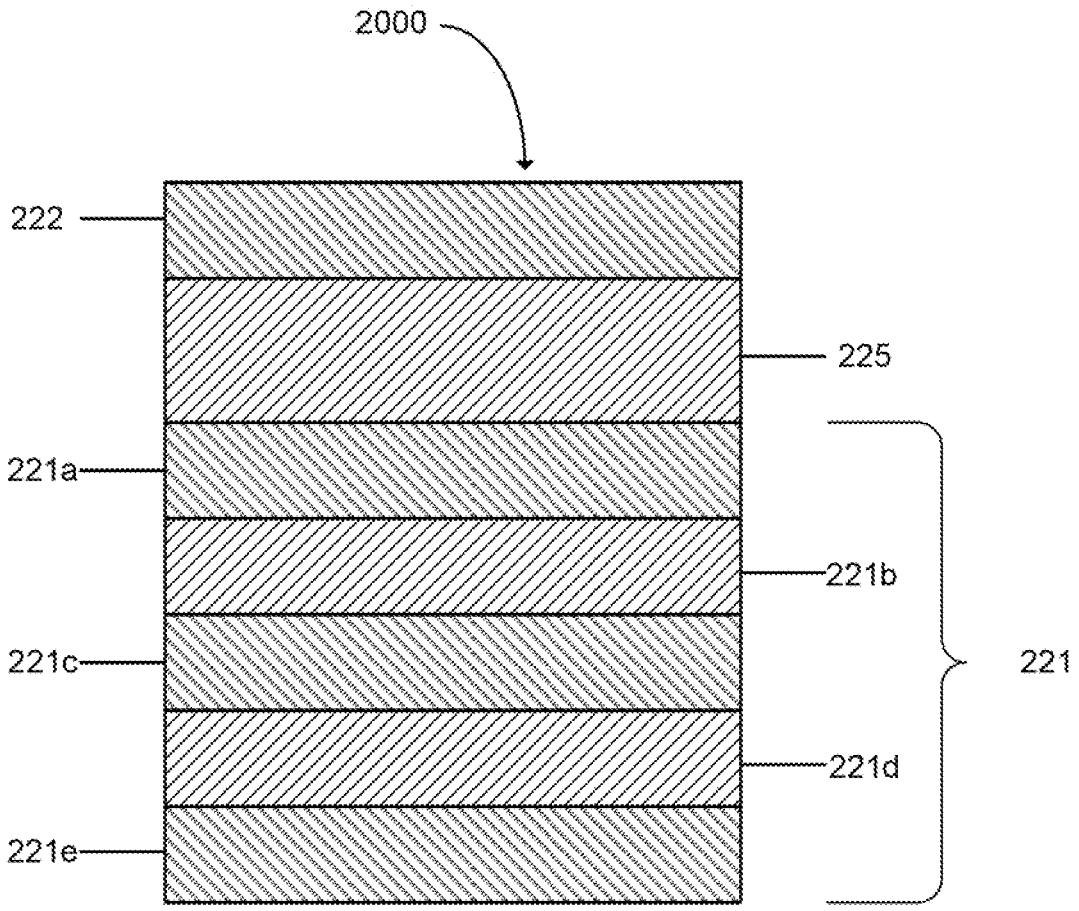
FIG. 10 is a cross-sectional view of a preferred embodiment of a flexible laminate suitable for use as a second wall panel in the present invention.

FIG. 10 illustrates a preferred embodiment of a laminate 2000 suitable for use as second wall panel 22 in the present invention. In this embodiment, laminate 2000 is identical to laminate 1000 with the exception that there is neither release lacquer coating 213 nor pressure sensitive adhesive coating 214 present in laminate 2000. Indeed, one laminate may be used in the construction of both first and second wall panels, 21 and 22 with a portion of the laminate receiving those printed sections of release lacquer coating 213 and pressure sensitive adhesive coating 214.

WORKING EXAMPLE

Example 1

Example 1 is one embodiment of laminate 1000 for use as a first wall panel 21 of the present invention having a structure and layer compositions as described below and as illustrated in FIG. 9. Reported below is the layer composition relative to the total weight of the layer.

Layer 212: 100 wt.-% of a 100 gauge biaxially oriented polypropylene film (BOPP)—Taghleef PST-2 BOPP (Taghleef Industries, Inc., Wilmington, Del., USA).

Layer 213: 100 wt.-% of a pattern-applied release lacquer—Siegwerk FSBM1B6DB (Siegwerk USA Company, Des Moines, Iowa, USA).

Layer 214: 100 wt.-% of a pattern-applied acrylic pressure sensitive adhesive—ROBOND® PS-68 Adhesive (Rohm and Haas Company, Philadelphia, Pa., USA).

Layer 215: 100 wt.-% of a flood coat of permanent pressure sensitive adhesive—ROBOND® L-90M Adhesive (Rohm and Haas Company, Philadelphia, Pa., USA).

Layer 211*a:* 73.8 wt.-% of a low density polyethylene (LDPE)—DOW™ LDPE 608A (Dow Chemical Company, Midland, Mich., USA), 24.6 wt.-% of a linear low density polyethylene (LLDPE)—ExxonMobil™ LLDPE LL 1001.32 (ExxonMobil Chemical Company, Houston, Tex., USA)+1.6 wt.-% of processing aids.

Layer 211*b:* 100 wt.-% of an anhydride-modified linear low density polyethylene copolymer—Bynel® 41E687 (E. I. du Pont de Nemours and Company, Wilmington, Del., USA).

Layer 211*c:* 100 wt.-% of an ethylene vinyl alcohol copolymer (EVOH)—Soarnol® ET3803 ethylene vinyl alcohol copolymer having a 38 mole % ethylene content (The Nippon Synthetic Chemical Industry Co., Ltd., Osaka, JAPAN).

Layer 211*d:* 100 wt.-% of an anhydride-modified linear low density polyethylene copolymer—Bynel® 41E687 (E. I. du Pont de Nemours and Company, Wilmington, Del., USA).

Layer 211*e:* 78.0 wt.-% of a linear low density polyethylene (LLDPE)—DOWLEX™ 2045G (Dow Chemical Company, Midland, Mich., USA), 15 wt.-% of a low density polyethylene (LDPE)—DOW™ LDPE 608A (Dow Chemical Company, Midland, Mich., USA) and 7 wt.-% of processing additives.

Example 2

Example 2 is one embodiment of laminate 2000 for use as a first wall panel 22 of the present invention having a structure and layer compositions as described below and as illustrated in FIG. 10. Reported below is the layer composition relative to the total weight of the layer.

Layer 222: 100 wt.-% of a 100 gauge biaxially oriented polypropylene film (BOPP)—Taghleef PST-2 BOPP (Taghleef Industries, Inc., Wilmington, Del., USA).

Layer 225: 100 wt.-% of a flood coat of permanent pressure sensitive adhesive—ROBOND® L-90M Adhesive (Rohm and Haas Company, Philadelphia, Pa., USA).

Layer 221*a:* 73.8 wt.-% of a low density polyethylene (LDPE)—DOW™ LDPE 608A (Dow Chemical Company, Midland, Mich., USA), 24.6 wt.-% of a linear low density polyethylene (LLDPE)—ExxonMobil™ LLDPE LL 1001.32 (ExxonMobil Chemical Company, Houston, Tex., USA)+1.6 wt.-% of processing aids.

Layer 221*b:* 100 wt.-% of an anhydride-modified linear low density polyethylene copolymer—Bynel® 41E687 (E. I. du Pont de Nemours and Company, Wilmington, Del., USA).

Layer 221*c:* 100 wt.-% of an ethylene vinyl alcohol copolymer (EVOH)—Soamol® ET3803 ethylene vinyl alcohol copolymer having a 38 mole % ethylene content (The Nippon Synthetic Chemical Industry Co., Ltd., Osaka, JAPAN).

Layer 221*d:* 100 wt.-% of an anhydride-modified linear low density polyethylene copolymer—Bynel® 41E687 (E. I. du Pont de Nemours and Company, Wilmington, Del., USA).

Layer 221*e:* 78.0 wt.-% of a linear low density polyethylene (LLDPE)—DOWLEX™ 2045G (Dow Chemical Company, Midland, Mich., USA), 15 wt.-% of a low density polyethylene (LDPE)—DOW™ LDPE 608A (Dow Chemical Company, Midland, Mich., USA) and 7 wt.-% of processing additives.

The above description and examples illustrate certain embodiments of the present invention and are not to be interpreted as limiting. Selection of particular embodiments, combinations thereof, modifications, and adaptations of the various embodiments, conditions and parameters normally encountered in the art will be apparent to those skilled in the art and are deemed to be within the spirit and scope of the present invention.

What is claimed:

1. A flexible peelable/resealable package comprising:

a top end and a bottom end generally opposite the top end;

a first side edge and a second side edge generally opposite the first side edge;

a first wall panel having an interior surface and an exterior surface, and comprising:

a thermoplastic sealant substrate forming the interior surface of the first wall panel and having an area defined by a length extending between the top end and the bottom end and a width extending between the first side edge and the second side edge;

an abuse layer forming the exterior surface of the first wall panel and having an area contiguous with the area of the sealant substrate of the first wall panel;

a printed release lacquer coating positioned on the abuse layer and having an area defined by a truncated length relative to the length of the sealant substrate of the first wall panel and a width extending between the first side edge and the second side edge; and a printed pressure sensitive adhesive coating positioned on the release lacquer coating and in direct contact with the sealant substrate of the first wall panel;

a second wall panel generally opposite the first wall panel having an interior surface and an exterior surface, and comprising;

a thermoplastic sealant substrate forming the interior surface of the second wall panel and having an area defined by a length extending between the top end and the bottom end and a width extending between the first side edge and the second side edge; and an abuse layer in direct contact with the sealant substrate of the second wall panel and forming the exterior surface of the second wall panel, wherein the abuse layer has an area contiguous with the sealant substrate of the second wall panel;

a first closed position comprising a transverse fusion seal and a first continuous core-line in the first wall panel positioned entirely between the top end and a transverse fusion heat seal; wherein the transverse fusion seal is superimposed over the area of the release lacquer coating of the first wall panel extending between the first side edge and the second side edge, and joins a section of the sealant substrate of the first wall panel to a section of the sealant substrate of the second wall panel thereby enclosing a product within the package;

an open position where the first wall panel and the second wall panel are separated proximal to the top end, and comprising an exposed section of the release lacquer coating on the interior surface of the first wall panel and an exposed section of the pressure sensitive adhesive coating; wherein the exposed section of the pressure sensitive adhesive coating is a portion of the interior surface of the second wall panel produced when transitioning from the first closed position to the open position; wherein the first continuous score-line is removed upon transitioning from the first closed position to the open position; wherein the section of the sealant substrate of the first wall panel fusion sealed to the section of the sealant substrate of the second wall panel is transferred from the first wall panel to the second wall panel upon transitioning from the first closed position to the open position; and a second closed position comprising an adhesive seal between the exposed section of the release lacquer coating on the interior surface of the first wall panel and the exposed section of the pressure sensitive adhesive coating on the portion of the interior surface of the second wall panel.

2. A package according to claim 1, further comprises a second continuous score-line in the first wall panel positioned between the transverse fusion heat seal and the bottom end.

3. A package according to claim 2, wherein the second continuous score-line in the first wall panel is generally parallel with the first score-line in the first wall panel.

4. A package according to claim 2, wherein the first and second continuous score-lines both extend from the interior surface of the first wall panel through the sealant substrate.

5. A package according to claim 2, wherein the first second continuous score-lines are both superimposed over the area of the release lacquer coating of the first wall panel.

6. A package according to claim 1, further comprising a first longitudinal side seal positioned proximal to the first side edge extending from the top end to the bottom end, and a second longitudinal side seal positioned proximal to the second side edge extending from the top end to the bottom end.

7. A package according to claim 6, further comprising a transverse end seal positioned proximal to the bottom end, and a longitudinal seal positioned between the first and second side edges and extending between the top edge and the bottom edge.

8. A package according to claim 1, wherein the first wall panel further comprises a permanent adhesive layer positioned between the sealant substrate and the pressure sensitive adhesive coating and has an area contiguous with the area of the sealant substrate of the first wall panel.

9. A package according to claim 8, wherein the first continuous score-line extends inward from the interior surface of the first wall panel through the sealant substrate and the permanent adhesive layer.

10. A package according to claim 9, wherein the first wall panel further comprises a second continuous score-line positioned between the fusion seal and the bottom end wherein the first and second continuous score-lines both extend inward from the interior surface of the first wall panel through the sealant substrate and the permanent adhesive layer.

11. A package according to claim 1, wherein the second wall panel further comprises a permanent adhesive layer positioned between the sealant substrate and the pressure sensitive adhesive coating and has an area contiguous with the area of the sealant substrate of the second wall panel.

12. A package according to claim 1, wherein the sealant substrate of both the first and second wall panels each comprise a mono-layer film.

13. A package according to claim 12, wherein the mono-layer film comprises a material selected from the group consisting of polyethylene, ethylene alpha-olefin copolymer, ethylene vinyl acetate copolymer, polypropylene and ionomer.

14. A package according to claim 1, wherein the sealant substrate of both the first and second wall panels each comprise a multi-layer film.

15. A package according to claim 14, wherein the multi-layer film comprises a heat sealable layer comprising a material selected from the group consisting of polyethylene, ethylene alpha-olefin copolymer, ethylene vinyl acetate copolymer, polypropylene and ionomer.

16. A package according to claim 14, wherein the multi-layer film comprises a first oxygen barrier layer comprising ethylene vinyl alcohol copolymer.

17. A package according to claim 1, wherein the abuse layer of both the first and second wall panels each comprise a material selected from the group consisting of polypropylene, polyester, polyamide and paper.

18. A package according to claim 17, wherein the abuse layer is a biaxially oriented polypropylene, a biaxially oriented polyethylene terephthalate, or a biaxially oriented polyamide.

19. A package according to claim 1, further comprising a flap to assist the transition from the first closed position to the open position which is positioned adjacent to the top end and comprises a section of the first wall panel unsealed to a section of the second wall panel.

20. A package according to claim 19, wherein the flap comprises a connecting member joining the section of the first wall panel unsealed to the section of the second wall panel, a first transverse intermittent score-line extending through the first wall panel which is positioned above the first continuous score-line, and a second transverse intermittent score-line extending through the second wall panel which is positioned generally parallel with the first intermittent score-lire of the first wall panel.

* * * * *